United States Patent [19]

Hunt et al.

[11] Patent Number: 4,506,649

[45] Date of Patent: Mar. 26, 1985

[54] VENT SYSTEM

[75] Inventors: Paul R. Hunt, Lindenhurst; Chester G. DuBois, Zion, both of Ill.

[73] Assignee: Outboard Marine Corporation, Waukegan, Ill.

[21] Appl. No.: 538,761

[22] Filed: Oct. 3, 1983

[51] Int. Cl.[3] ..... F02B 1/00

[52] U.S. Cl. ..... 123/576; 123/577; 251/149.6; 137/322

[58] Field of Search ..... 114/211, 212; 440/1, 440/900; 123/576, 577, 180 R, 187.5, 180 AC; 137/322, 321, 614.03; 251/149.6, 149.8

[56] References Cited

U.S. PATENT DOCUMENTS

| | | | |
|---|---|---|---|
| 2,060,432 | 11/1936 | Squires | 251/321 |
| 2,144,427 | 1/1939 | Longstreet | 251/321 |
| 3,715,099 | 2/1973 | Shendure | 251/149.6 |
| 4,040,456 | 8/1977 | DeFrees | 141/349 |
| 4,269,219 | 5/1981 | Dybvig | 137/322 |
| 4,437,448 | 3/1984 | Billingsley | 123/577 |

*Primary Examiner*—E. Rollins Cross

*Attorney, Agent, or Firm*—Michael, Best & Friedrich

[57] ABSTRACT

A fuel system for a dual fuel outboard motor having a fuel connector in position to have a second connector connected to it to enable fuel to be transfered to the motor from a remote fuel tank via a hose leading to the second connector. A small tank of starting fuel is mounted on the motor and has a vent and a vent conduit leading to a valve in the motor-mounted fuel connector. The valve opens and closes the vent in response to connection and disconnection, respectively, of the connectors.

9 Claims, 2 Drawing Figures

VENT SYSTEM

FIELD OF THE INVENTION

This invention relates to a vent for a gas tank for a dual fuel (gasoline and kerosene) engine.

BACKGROUND OF THE INVENTION

Dual fuel outboard motors are used in the far east for the most part. The motor is started and warmed up using gasoline and then transfered to kerosene. Only a small gas tank is required and it is typically located under the upper engine cover. It has to be vented. This has been done with a screw vent in the tank or cap which necessitates removal of the engine cover to open or close the vent. If the operator does not close the vent, gasoline can spill out when the motor is transported. That is a fire and explosion hazard. It is desirable to make the vent automatic to make the use of the engine simpler and to eliminate human error.

The prior art shows fuel couplings incorporating a valve which is opened by the coupling action to vent the tank being connected. See U.S. Pat. No. 4,269,219 and 4,040,456. These patents do not vent a tank different than the tank being connected.

SUMMARY OF THE INVENTION

An object of this invention is to provide a vent system for an outboard motor having a small gasoline tank or bottle mounted on the motor with a vent conduit leading to the fuel connector to which a remote fuel tank is connected via a hose and mating connector. The connector on the motor includes means responsive to connection of the connectors to open the vent conduit.

A further aspect of the invention is making the responsive means in the form of a spring loaded valve having a stem projecting from the motor connector to be pushed into the connector to unseat the valve when the connection is made.

Stated another way, this invention provides fuel system for a dual fuel outboard motor designed to be run on kerosene supplied to it from a remote tank through a fuel connection on the motor. The connection is easily connected or disconnected. Such motors require gasoline or an equivalent high volatility fuel for staring and warm up. This invention provides a small tank for such fuel mounted on the motor with a vent for the tank and means for opening the vent when said connection is made and for closing the vent when said connection is disconnected.

This invention is not limited to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DETAILED DESCRIPTION OF THE DRAWINGS

Figure 1:
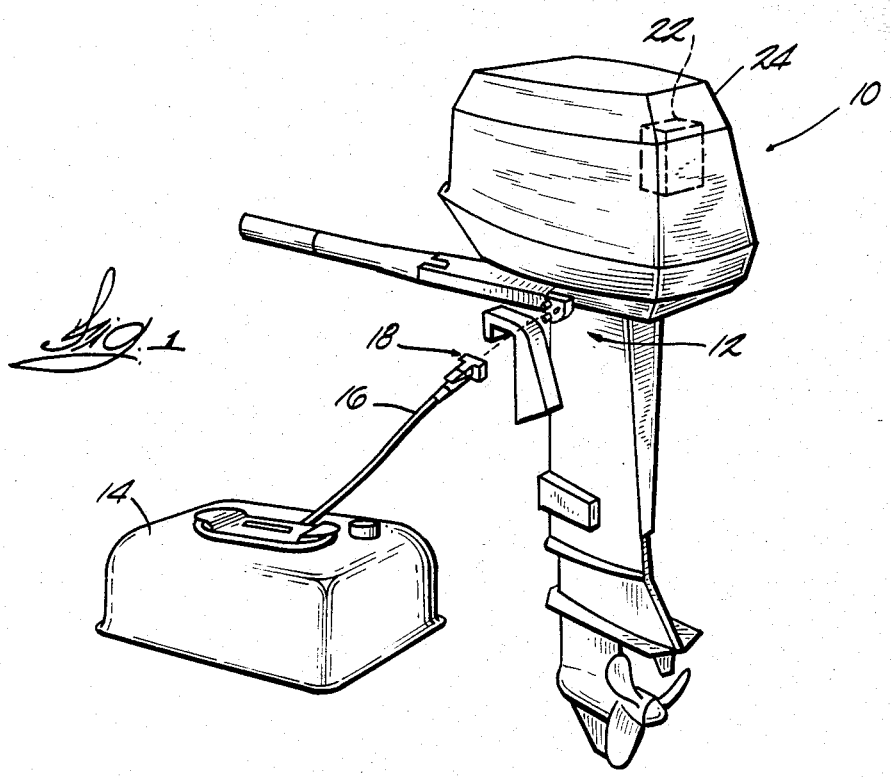
FIG. 1 is a simplified view of an outboard motor showing the location of the connector to which the remote fuel tank and vent are connected.
Figure 2:
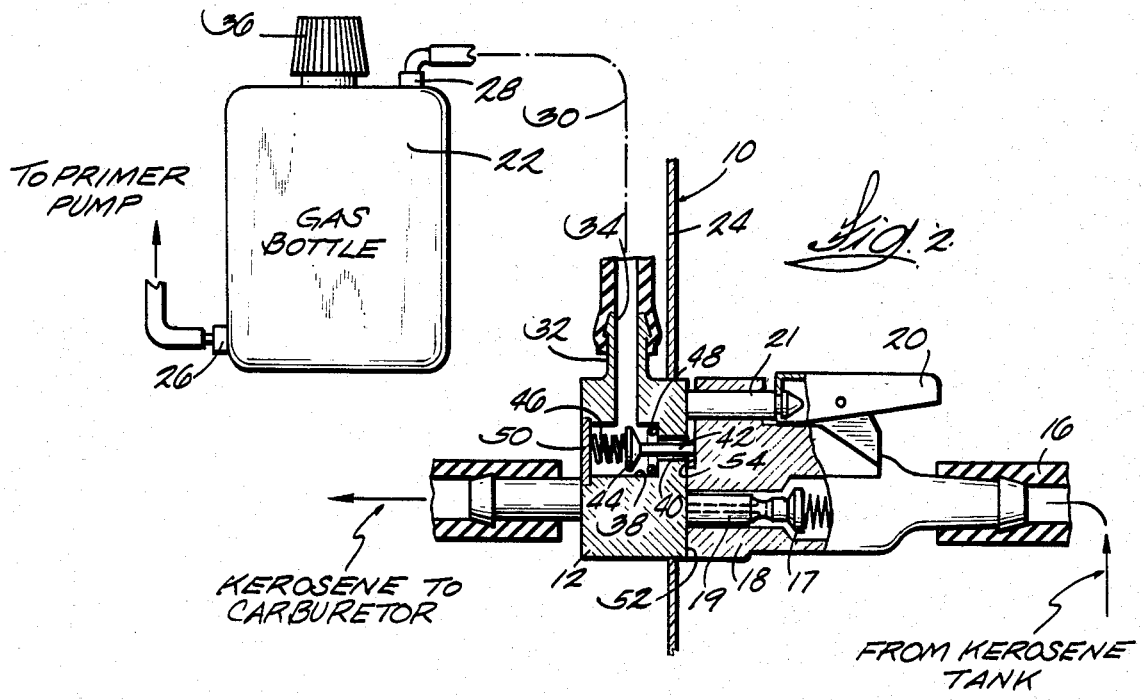
FIG. 2 is a schematic showing of the connection and automatic vent for the gasoline bottle.

Typically, an outboard motor 10 has a male fuel connection 12 on the left side of the lower case of the motor positioned for easy access. A remote portable fuel (kerosene) tank 14 has a hose 16 provided with a mating female connector 18 which has the typical hole in which a spring loaded shutoff valve 17 is located. The pin or tube 19 projecting from the connector 12 opens valve 17 while the latch pin 21 projects into a hole in connector 18 to be engaged by a spring loaded latch 20 to lock together the mating connectors. In a dual fuel motor the tank 14 contains kerosene or other relatively inexpensive fuel which is pumped to the motor by the fuel pump in the motor. The remote tank is vented at the tank just like the typical remote gas tank.

In order to facilitate starting, a small bottle (tank) 22 is mounted under the upper cover 24 and contains gasoline or other volatile fuel. The bottle has a lower outlet 26 connected to the usual primer pump (not shown) and has an upper vent 28. Vent tube 30 connects the vent 28 to the nipple 32 leading to a passage 34 through connector 12. The bottle is filled through cap 36.

Passage 34 includes a cross passage 38 leading to a reduced diameter passage 40 receiving valve stem 42. The stem clearance is reasonably tight but even slight leakage along the stem is enough to vent the gas bottle 22. Poppet valve 44 is biased by compressed spring 46 to seat on the O-Ring seat 48 mounted on the shoulder between passages 38 and 40. Cover or plug 50 closes the end of passage 38. When the remote connector 18 is disconnected, stem 42 projects outwardly from the face 52 of connector 12 and valve 44 automatically closes the vent. The motor can be transported, etc without loss of gasoline through the vent.

When the kerosene tank is connected to the motor by latching connectors 12 and 18 together, the stem 42 is pushed in against the bias of spring 46 to open valve 44 and vent the bottle 22 through tube 30 and the clearance around the valve stem. Connectors 12 and 18 always have some clearance between the confronting faces 52, 54 so there is ample air supply to the stem clearance. When connectors 12 and 18 are disconnected, the check valve 17 closes and the vent valve 44 closes. The very small amount of kerosene in the line from the connector 12 to the carburetors can run out.

We claim:

1. A fuel system for a dual fuel outboard motor, said system comprising an outboard motor having a fuel connector mounted thereon in position to have a second connector connected to it to enable fuel to be transferred to the motor from a fuel tank via a hose leading to the second connector, a second tank of starting fuel fixed to the motor, said second tank having a vent, and valve means operative to open and close said vent in response to connection and disconnection, respectively, of said fuel connector and the second connector.

2. A fuel system according to claim 1 in which said valve means is located in said fuel connector and further including a vent conduit between said vent and said fuel connector.

3. A fuel system according to claim 2 in which said valve means is a poppet valve having a stem projecting from said fuel connector far enough to be engaged by the second connector prior to completing the connection, and a spring biasing by said poppet valve closed.

4. A fuel system according to claim 3 in which said fuel connector and the second connector have respective confronting faces and in which said valve stem projects from said confronting face of said fuel connector, and further including a clearance around said stem comprising an air passage communicating with said conduit and said vent.

5. A fuel system for a dual fuel outboard motor having a gasoline tank mounted on the motor, said system comprising a fuel connector mounted on the motor, a separate fuel tank having a fuel hose with a mating connector for connection with said fuel connector, said fuel connector including a valve biased to its closed position and opened by said mating connector when said mating connector is connected to said fuel connector, and a vent conduit between said gasoline tank and said valve so that said gasoline tank is vented through said valve when said fuel and said mating connectors are connected.

6. A vent system for a dual fuel outboard motor, said system comprising a gasoline supply tank mounted on the motor, a fuel connector on the motor, a vent conduit from said supply tank to said fuel connector, a fuel tank including a hose and a connector, and means responsive to connecting said fuel tank connector to said connector on the motor for communicating said vent conduit to the atmosphere.

7. A fuel system for a dual fuel outboard motor designed to be run on kerosene supplied to it from a remote tank through a fuel connection on the motor, the connection being easily connected or disconnected, the motor requiring gasoline or an equivalent high volatility fuel for starting and warm up, said fuel system comprising a small tank for such fuel mounted on the motor, a vent for said small tank, means for opening said vent in response to making said connection and for closing said vent in response to disconnection of said connection.

8. An outboard motor having a fuel connector mounted on the motor, a locating latch pin projecting from said connector, a fuel tube extending in said connector parallel to said pin and adapted to receive fuel from a fuel tank remote from the motor, a gasoline tank mounted on the motor, a vent conduit leading from the gasoline tank to said connector, a passage in said connector between said conduit and atmosphere, a valve in said passage controlling flow through the passage and including a stem projecting from said connector parallel to said pin and tube, and a spring biasing said valve closed.

9. An outboard motor having a motor carburetion system, a gas tank mounted in the motor, a fuel connector mounted on the motor, connected to the said motor carburetion system, and being adapted for connection to a remote fuel supply, a vent conduit from said gas tank to said connector, a passage through said connector from said vent conduit to atmosphere, a valve in said passage and having a stem which projects from said connector and which can be depressed to open said valve, and a spring biasing said valve closed.

* * * * *